US005230662A

United States Patent [19]

Langford

[11] Patent Number: 5,230,662

[45] Date of Patent: Jul. 27, 1993

[54] WATERSLIDE WITH UPHILL RUN AND FLOTATION DEVICE THEREFOR

[76] Inventor: Frederick Langford, 212 Crest Rd., Cape May Court House, N.J. 08210

[21] Appl. No.: 693,557

[22] Filed: Apr. 30, 1991

Related U.S. Application Data

[63] Continuation-in-part of Ser. No. 499,622, Mar. 26, 1990, Pat. No. 5,011,134.

[51] Int. Cl.[5] ..... A63G 21/10

[52] U.S. Cl. ..... 472/117

[58] Field of Search ..... 272/565 R; 472/117, 472/116, 88, 128; 104/69, 70

[56] References Cited

U.S. PATENT DOCUMENTS 5,011,134 4/1991 Langford ..... 272/56.5 R

*Primary Examiner*—Richard E. Chilcot, Jr.

*Attorney, Agent, or Firm*—Eckert Seamans Cherin & Mellott

[57] ABSTRACT

A waterslide defined by a trough proceeding generally downhill and carrying water to be skimmed over by a rider, is arranged with successive uphill and downhill sections at a crest. Water injection ports along the uphill section approaching the crest are inclined in the direction of motion and assist slower riders over the crest. The same ports can direct sufficient water over the crest for braking faster riders along the downhill section. A portion of the water injected along the uphill section flows backwards to a low point. An elongated drain at the low point prevents pooling of water tending to slow down the riders. A pad for supporting the rider while traversing the waterslide has a U-shaped bow support web disposed at a front of the apparatus, with spaced legs extending rearwardly and an integral handle graspable by the rider. Two integral web and handle members are wrapped part way around by the leading edge of the pad and attached thereto by push pin fasteners.

20 Claims, 4 Drawing Sheets

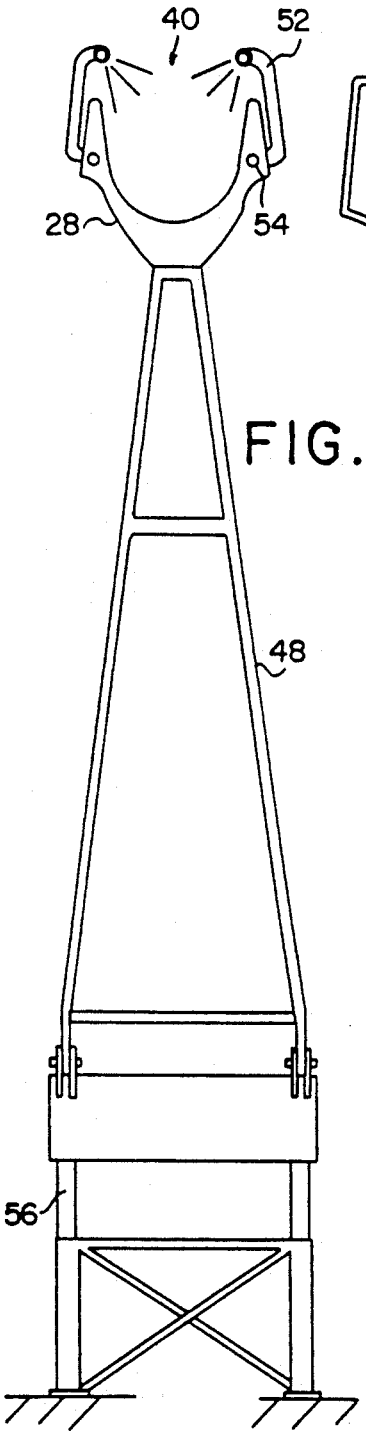
FIG. 5
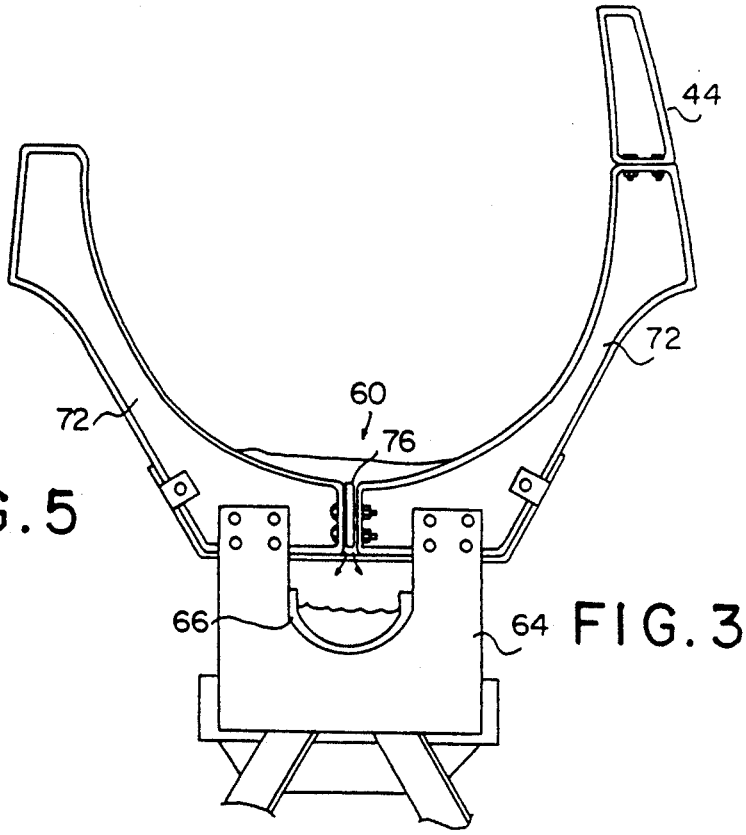
FIG. 3
FIG. 4
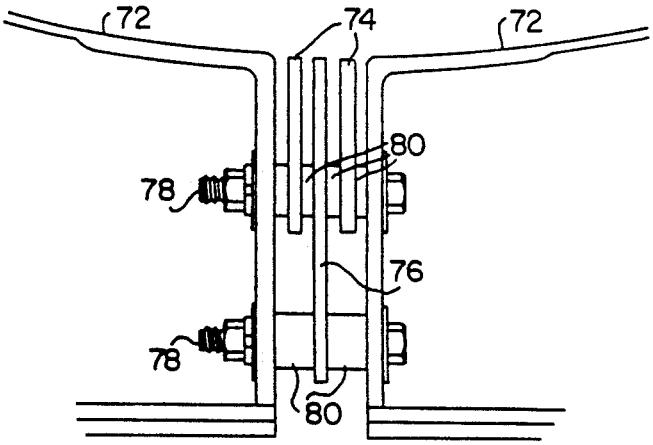

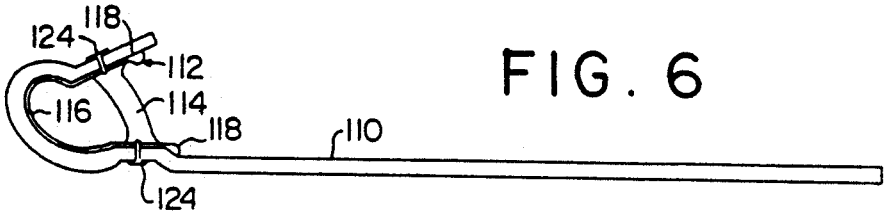
FIG. 6
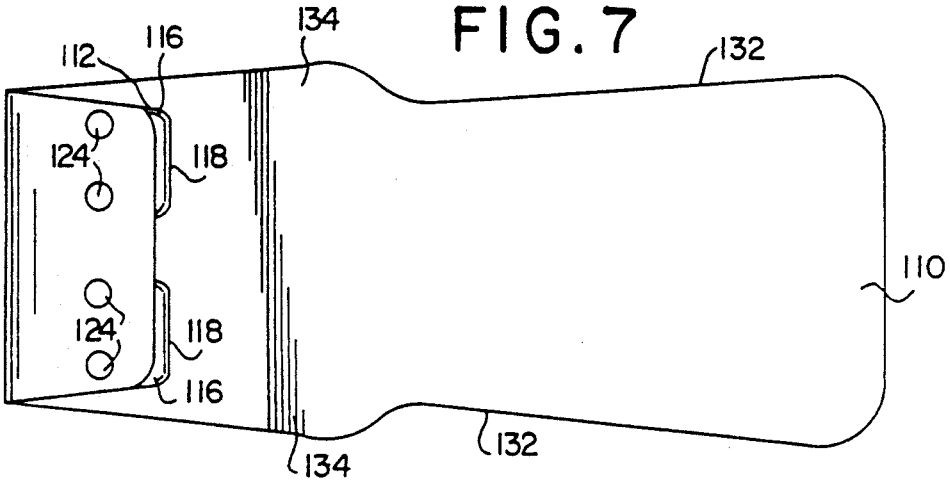
FIG. 7
FIG. 8
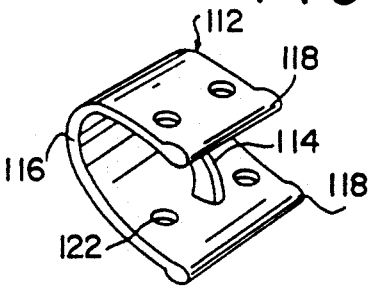
FIG. 9
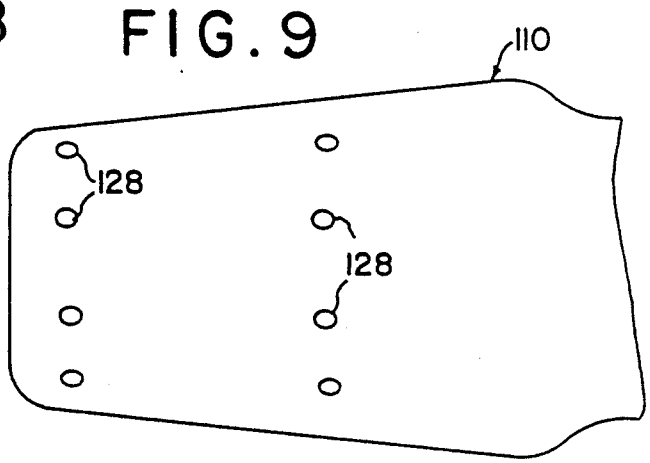

WATERSLIDE WITH UPHILL RUN AND FLOTATION DEVICE THEREFOR

CROSS REFERENCE TO RELATED APPLICATION

This is a continuation in part of copending application Ser. No. 499,622, filed Apr. 30, 1991, now U.S. Pat. No. 5,011,134, dated Apr. 30, 1991.

BACKGROUND OF THE INVENTION

1. Field of the Invention

This invention relates to the field of large scale waterslide rides and flotation devices for users of the rides. Riders preferably carried on the flotation devices are propelled by gravity along a rollercoaster-like progression of downhill runs and at least one uphill run leading into a downhill run. Leading into the uphill run a drain means extracts water which would otherwise form a pool preventing the riders from maintaining sufficient velocity to traverse the uphill run. Whereas heavier and more experienced riders more easily pass the top of the uphill run than lighter or less experienced riders, the invention further includes inclined water jets leading into the top of the uphill run, for boosting the lighter and less experienced riders over the crest, and also forming a braking quantity of water on a downhill section following the crest.

2. Prior Art

Waterslide rides are subject to substantial variation in the topography of the course and in the nature of the flotation equipment, if any, which users or riders employ in traversing the ride. However, there are certain basic requirements inherent in a waterslide due to the need to move the riders and the water from a start at a relatively higher elevation to a finish at a relatively lower elevation, by force of gravity. On a typical ride, the riders proceed along a continuous downhill path, moving together with water flowing through a channel defined by a sluice or trough. The riders as well as the water are propelled by gravity, and normally tend to move at or near the same speed.

It is possible for a rider to exceed the speed of the water flowing in the sluice in some forms of rides. The water is subject to certain frictional influences associated with fluid flow, such as eddies and the like. Along a particular downhill run of the sluice, a rider may tend to skim over the surface of flowing water, in excess of the flow speed of the water. Waterslides also may have sinuous lateral bends along the path from the start to the finish, enabling the riders to steer to some extent onto the sidewalls of the sluice, thereby escaping frictional or viscous slowing due to passage through relatively slower moving water and skimming along the sluice wall. Means for adding water can be provided on banked sidewalls, such as misters, geysers and the like. These inject water into the trough either at a high point of a sidewall or at spaced points on the surface of a sidewall to permit the rider to skim over a wet sidewall surface at low friction.

Copending U.S. patent application Ser. No. 437,445, filed Nov. 15, 1989 (now U.S. Pat. No. 5,020,465), entitled "Wide Track Waterslides and Coupleable Flotation Apparatus Forming Lines and Arrays" discloses a waterslide structure wherein the sidewalls of the sluice are provided with high wetted banks around the outside of sinuous lateral bends in the trough. Riders can employ centrifugal force to follow a trajectory upwardly on the banked sidewalls, the rider moving uphill around these sections and escaping the fluid dynamic slowing of a buoyant body moving through a body of water. Geysers or misters keep the banked outside walls wet and slippery. However, the lowest points of the sluice at all points of cross-section from the start to the finish proceed continuously downhill, i.e., there is a continuous downward gradient from start to finish.

If the lowest points in each successive cross-section of the sluice along the sluice or channel proceeds uphill, i.e., if the gradient changes from downhill to uphill, a pool of water collects at the low point. The pool of water exerts a fluid dynamic braking action on the riders. Unless the rider can avoid the pool, for example by means of a banked turn as in the above-mentioned disclosure, the reduction in rider speed due to the pool makes it impossible or impractical to employ an up-and-down rollercoaster configuration of the waterslide. The rider simply splashes into a pool forming between a downhill section and a subsequent uphill section, the kinetic energy accumulated by the rider along the previous downhill section being absorbed in the pool. It is possible to traverse a shallow pool, for example at a relatively minor hump along a waterslide, but water fills the channel to the level of the hump. If the waterslide is designed with a rollercoaster-like long downhill run followed by a substantial uphill run, the pool may fill the channel completely, and moreover, the rider's downhill momentum forces the rider downward into the pool, further adding to fluid dynamic braking. To maintain a good speed along the waterslide, it has been necessary to maintain at least a substantially continuous downhill gradient to avoid pooling.

Waterslides may be used by riders with or without flotation equipment. Abrasion resistant canvas-covered air mattresses and tubes are known for use in waterslides, and various boat-like devices are known for flume-type rides. In a tube, the rider generally sits upright. The rider may sit on an air mattress or buoyant pad, but in a fast ride will generally lay prone. If riding feet-first on a mattress or pad the user is less able to steer, and for steering will typically lay face down and head-first. The character of the ride to a large extent determines the appropriate flotation equipment, if any. In connection with a ride carrying a large flow of water, boat-like devices are preferred, however, the speed of a boat substantially determined by the speed of the flowing water. In connection with a ride wherein the riders skim the surface of very shallow water and/or the sluice walls some form of supporting device is preferred to protect the rider from abrasion, smaller and flatter supports such as air mattresses or buoyant pads being appropriate for fast rides.

A rider of a support such as an air mattress or buoyant pad typically grasps the front edge of the support with both hands while lying prone face down, and looking forward. There is some danger of abrasion to the hands in this position, and should an obstacle or other braking effect be encountered, the rider is inclined to pitch forward over the front of the device. Where the braking effect is a pool of water, the rider may not only pitch forward, but furthermore may dive downwardly into the pool. There is a possibility of injury, particularly because the pool is likely to be relatively shallow.

A mat is often superior to an air mattress or tube because the mat is flat on the bottom and is more apt to skim the surface of a pool of water. A thin mat is more difficult to grasp than an air mattress in a manner that protects the user from abrasion of the hands, frontal impacts and the like.

Waterslide rides are disclosed in Rouchard U.S. Pat. No. 4,149,710—; Myers U.S. Pat. No. 3,923,301; Rohmer U.S. Pat. No. 1,648,196; and, Libbey U.S. Pat. No. 419,860. In each case the rides progress continuously downhill. Reference can be made to the patents, however, for particulars regarding the production and use of chutes and chute sections, particularly as to Rouchard, wherein chute segments are made from fiberglass reinforced resin, which material is preferred in the present case. The teachings of the above-mentioned application and the foregoing patents are hereby incorporated.

The present invention provides both an improved waterslide and a flotation device adapted specifically for the waterslide. The ride is quite fast and employs a rollercoaster-like progression of downhill and uphill gradients. The walls of the slide can be provided with optional uphill trajectory paths around banked lateral curves, but moreover, to avoid the braking effects of pooled water at low spots between downhill and successive uphill runs, water is extracted from the sluice by a particular elongated drain means disposed at the low point in the path. The successive uphill section is traversed by skimming over a thin quantity of water injected at spaced points along the uphill traverse of the path, which water flows downwardly opposite the rider path. By removing the pool normally associated with the low point in a sluice, it is possible to obtain substantial velocity through the low point and up the successive uphill section. Preferably, the path is arranged to maintain sufficient rider velocity at the apex of the uphill section to enable the user to become weightless or even to become airborne when passing the top of the uphill section. The ride is fast and exciting, by virtue of a rollercoaster-like topography which normally would be precluded by the need to manage a downhill flow of water without pooling.

The velocity of the rider at the crest of an uphill section followed by a downhill section depends to some extent on the weight and skill of the rider. Heavier riders and riders who are adept at avoiding frictional influences such as contact with the walls can develop substantially higher speeds than others. It is advisable to operate a waterslide such that all the riders traverse the crest of the hill rather than fall back, and also to ensure that the best riders do not move so fast as to be in danger of flying over the sidewalls due to excessive elevation. According to the invention, a series of assist jets are disposed along the uphill section leading to the crest, and are inclined forward in the direction of rider motion to assist lightweight riders over the crest. This same quantity of assist water is preferably directed at a low enough angle of incidence and with sufficient force to pass over the crest. As a result, lightweight riders pass the crest and heavier or more skillful riders encounter an additional quantity of water on the following downhill run, tending to brake their velocity.

A special form of flotation mat is provided to enable the user to traverse the ride safely at maximum velocity. The flotation mat is basically a thin buoyant mat, but includes at least one formed handle member around which the mat material wraps and attaches to form a blunt leading edge which cushions impacts and contains the rider behind the bow of the mat. The handle member is safely grasped by the rider behind the bow. The lateral sides of the mat are angled outwardly from the front, and in conjunction with the handle(s) enable the rider to steer the mat as it slides along the waterslide path.

SUMMARY OF THE INVENTION

It is an object of the invention to improve the safety and excitement of waterslides, in part by increasing the possible speed at which a rider can safely traverse the slide and in part by arranging a trajectory path which is quite fast notwithstanding rollercoaster-like topographical features including successive downhill and uphill runs.

It is also an object of the invention to provide a large scale waterslide ride wherein pooling of water does not slow the rider's passage, but adequate water is retained to allow the rider to skim the surface of the waterslide trough or chute.

It is a further object of the invention to balance the operation of a waterslide to accommodate a range of rider skillfulness, by assisting less skillful riders over hill crest and braking more skillful riders following the hill crest.

It is yet another object of the invention to improve the safety of a thin waterslide mat by providing a simple and inexpensive means for converting the mat into a frontally protected flotation and sliding device having secure protected appendages for the rider to grasp.

These and other objects are achieved according to the invention by a waterslide defined by a trough proceeding generally downhill and carrying water to be skimmed over and through by a rider, arranged with successive uphill and downhill sections. An elongated drain at a low elevation between the uphill and downhill sections prevents pooling of water tending to slow down the rider. Water is injected into the trough a relatively higher elevations on both the downhill and uphill sections, establishing a gravity flow of water in a forward direction relative to the rider path along the downhill section and in the reverse on the uphill section. The downhill section and the subsequent uphill section are dimensioned such that kinetic energy accumulated by the rider carries the rider over the uphill section and the arc over the uphill section can be parabolic along a free fall trajectory of the rider.

The free fall trajectory is arranged for the rider of median weight and riding skill. To assist slower riders over the crest of the hill, at least one jet of water is directed along the rider's path approaching the crest of the hill, preferably a series of successive jets inclined relative to the rider's path and having sufficient velocity to pass over the crest to a following downhill section. This water, and/or additional water injected along the path in the following downhill section, tend to brake the velocity of those riders whose weight or riding skill is such that they become airborne over the crest. Where the downhill section following the crest leads into a pool at the end of the waterslide, the braking action of the additional water limits the travel of the faster riders over the surface of the pool, allowing a shorter pool, and decreases chances of collision.

A pad for supporting the rider while traversing the waterslide has a U-shaped bow support web disposed at a front of the apparatus, with spaced legs extending rearwardly and an integral handle graspable by the rider. Two integral web and handle members are wrapped part way around by the leading edge of the pad and attached thereto by push pin fasteners.

BRIEF DESCRIPTION OF THE DRAWINGS

There are shown in the drawings the embodiments of the invention as presently preferred. It should be understood that the invention is not limited to the precise arrangements and instrumentalities shown, and is capable of embodiment in other variations and groupings of sub-elements. In the drawing:

FIG. 3 is a partial section view along lines 3—3 in FIG. 1, showing construction of the water extraction section;

FIG. 4 is a partial section view corresponding to FIG. 3, in detail, illustrating a preferred drain configuration;

FIG. 5 is a partial section view taken along lines 5–5 in FIG. 1;

FIG. 6 is a side elevation of a rider support mat according to the invention;

FIG. 7 is a plan view of the rider support mat of FIG. 6;

FIG. 8 is a perspective view of a bow support member to be wrapped with the end of the buoyant pad;

FIG. 9 is a partial plan view showing the leading end of the buoyant pad;

DETAILED DESCRIPTION OF THE PREFERRED EMBODIMENTS

Figure 1:
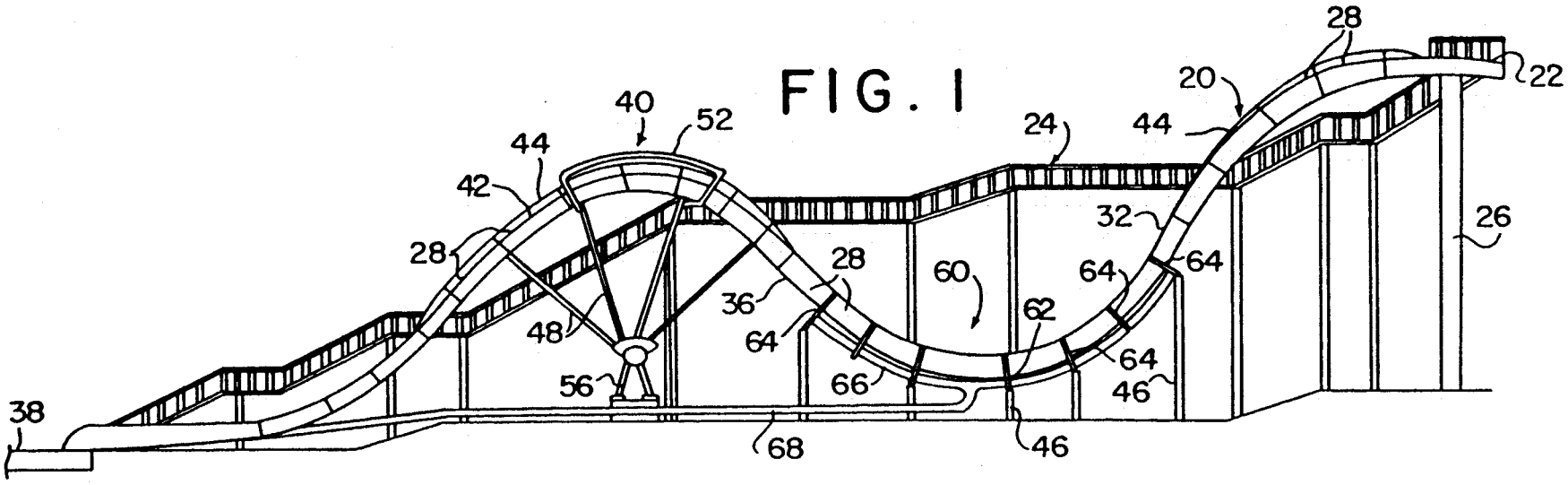
FIG. 1 is a side elevation view of a waterslide according to the invention, showing the full slide from start to finish.

A waterslide ride according to the invention is shown in elevation in FIG. 1. The ride follows a course from a point of higher elevation at an entry pool 22, along a path defined by a plurality of smoothly connected trough or chute segments 28, to a finish at a splash-down pool 38. The path of the waterslide can have lateral bends, however, for purposes of convenient illustration, an embodiment without lateral bends has been illustrated.

The overall gradient of the course from start to finish is such that a rider traverses the entire course by force of gravity. However, it is conceivable that the course could be included in a larger course wherein additional means were provided to lift the riders in order to continue along a further path subsequent to that shown. A quantity of water is carried in the chute segments, flowing by gravity and supporting the riders in the chute. The water both supports the riders and reduces friction between the riders (and more particularly their support mats) and the chute walls.

Riders are both carried along with the flow of water, and able to skim over the surface of the water at a velocity greater than the water flow. Although the overall gradient is sufficient to carry the riders from the start 22 to the finish 38 by gravity, the course has at least one rollercoaster-like downhill section 32 following an uphill section 36. As a result, there is a relatively low area between the downhill and successive uphill sections, where water will tend to pool. According to the invention, water injected at the start area, which flows downhill toward the low area, is extracted at the low area to prevent pooling. An elongated drain is provided at the low area, for extracting water over an elongated area, whereby sufficient water remains for the riders to skim over, but the water along the low area is too shallow to present substantial resistance to the rider due to the buildup of a bow wave, and/or other fluid dynamic retarding influences characteristic of a boat or the like moving in a body of water. To enable the rider to traverse the uphill section, a water addition apparatus 52 is provided at the peak of the uphill section 36. At least some of the water added along the uphill section flows backwards relative to the path of the riders, and is also extracted at the elongated drain. The riders skim over the backward flowing water due to the kinetic energy built up along the course to that point.

A further downhill section 42 is preferably included along the path following the uphill section, with the water addition means also injecting a flow for this section. The quantity of water added to the further downhill section 42 can be greater than that added to flow backwards along the uphill section 36, this water flowing forward with the riders of the finish or splash down pool 38.

The waterslide includes an elongated trough or chute 20 defining a rider path proceeding generally from a higher elevation to a lower elevation, the trough 20 having a downward gradient whereby a rider can traverse the path substantially by force of gravity, and at least one downhill section 32 followed by an uphill section 36. A first means 50 injects water into the trough 20 adjacent a point 22 of relatively higher elevation of the trough 20 along the path, thereby establishing a gravity flow of water in a forward direction relative to the rider path along the downhill section of the trough toward an area 62 of relatively lower elevation between the downhill section 32 and the uphill section 36. A water extraction means 60 is disposed adjacent the area 62 of relatively lower elevation for removing water from the trough.

The uphill section 36 could conceivably define the end of the path, and in that case the low area 62 can be arranged to lead laterally to a splash down pool. The riders would proceed from the downhill section 32, upwardly along uphill section 36 as high as possible, then back down section 36 into the low area 62, where the riders can exit laterally. However preferably, the downhill section or sections 32 and the subsequent uphill section or sections 36 along the rider path are dimensioned such that energy accumulated by the rider between a start 22 of the waterslide and the end of each uphill section 36 is sufficient to carry the user over the uphill section. If desired, alternative exits can be provided along the low sections, and passage of the uphill sections could then require a certain riding skill. Preferably, the ride has only one path and is arranged such that the riders all easily pass over each peak defined by the junction of an uphill section 36 and subsequent downhill section 42. For this purpose, the alternative embodiment according to FIGS. 11 and 12 includes a particular form of water addition means which both assists slower riders in passing the crest of the hill, and decelerates the faster riders in the following downhill section approaching the splash down pool. This embodiment is discussed in detail hereinafter.

In addition to the initial water injection means 50 in the embodiment according to FIG. 1, a second means 52 is provided for injecting water into the trough adjacent an area of relatively higher elevation along the uphill section 36 of the trough, thereby establishing a flow of water in a backward direction relative to the rider path along said uphill section 36 of the trough, said flow of water in the backward direction being sufficient to reduce surface friction along the uphill section 36.

Figure 2:
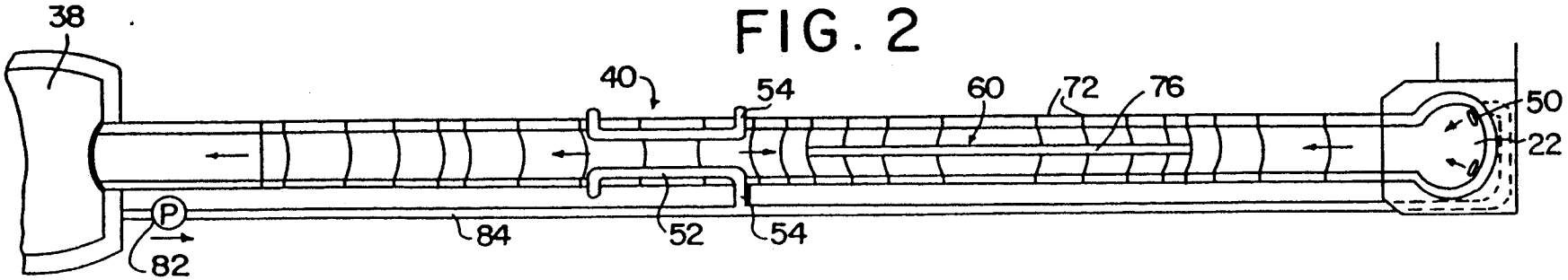
FIG. 2 is a plan view of the waterslide according to FIG. 1.
Figure 10:
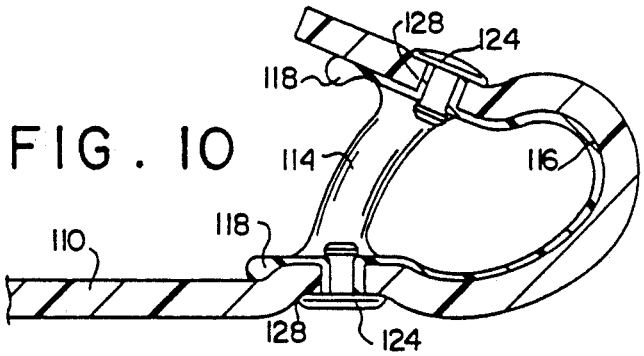
FIG. 10 is a detailed section view showing the attachment of the bow support member and the buoyant pad.

The uphill section 36 is followed by a further downhill section 42 along the rider path. A third means is provided for injecting water into the trough adjacent an area of relatively higher elevation along the further downhill section, thereby establishing a flow of water in a forward direction along the rider path at the further downhill section. The third water injection means can be continuous with the second, i.e., being formed by a continuation of the second water injecting means directed toward the further downhill section 42 rather than the uphill section 36. Preferably, water is injected over a length along the path at and adjacent the peak 40 defined between the uphill section 36 and the further downhill section 42. This can be accomplished by at least one water carrying conduit 54, which recycles water from the splash down pool 38 to the area of peak 40. As shown schematically in the plan view of FIG. 2, a pump 82 returns water along conduit 84 from the splash down pool to the water injection means 52 disposed at peak 40, and also to the entry pool 22 at the beginning of the waterslide.

The quantity of water directed backwardly along the rider path (i.e., along the uphill section 36) is preferably less than the quantity directed forwardly along the further downhill section 42. The division of the water can be made by the size or number of orifices in conduits 54 of water injection means 52. For example, a mist-like spray can be directed backwardly along the path to merely ensure that the surface of uphill section 36 remains wet and slippery; whereas a more substantial quantity of water can be directed forwardly on the further downhill section such that the rider ultimately arrives at the splash down pool 38 in a gush of water. As shown in FIG. 1, the conduits leading to water injection means 52 can be external to the chute segments 28. Alternatively, as shown in FIG. 5, internal conduits 54 can feed the water injection means 52. In the preferred embodiment shown, the water is directed downwardly from above. It is also possible to have the water injected upwardly from the bottom surface of the chute (as a geyser), or downwardly along the top edges of the sidewalls, or by other means.

One objective of the invention is a fast and exciting ride. While in a rollercoaster-like configuration as shown, the kinetic energy accumulated by the rider between said start 22 and the peak 40 at the end of any uphill section must be sufficient to pass the peak (or the rider slides back down), preferably the respective downhill and uphill runs are dimensioned such that this kinetic energy is substantially greater than sufficient to carry the user over the uphill section, whereby the rider free falls over at least a part of the further downhill section following the peak. For safety purposes, high sidewalls 44 are provided on the chute in this section to contain the rider notwithstanding any lateral momentum which may be achieved.

The precise velocity of a rider over the peak 40 will depend on the manner in which the rider traverses the previous sections of the course. In addition, heavier riders, whose greater inertia tends to make them less subject to frictional influences and minor obstructions, will pass over the peak 40 at a higher speed than lighter riders. The course can be configured such that the lighter riders will easily pass, but heavier or more experienced riders (who are also likely to be older) then may become airborne over peak 40. In the preferred embodiment, the initial vertical drop of downhill section 32 is about 58 feet, at an angle of about 55° downwardly from horizontal at the cusp between the downwardly opening U-shape of the initial chute portion and the upwardly opening U-shape of the low area 62. The uphill section then has a vertical extension of about 51 feet, at an approximate angle of 45° at the next cusp leading into the area of peak 40. It is also possible to include a preliminary section (not shown) just after the entry at starting pool wherein an increased downward slope brings the riders immediately up to an increased speed upon entering the course.

Preferably, the contour of the peak 40, i.e., the area of transition between the uphill section 36 and the further downhill section 42, defines a parabolic arc substantially matched to a free fall trajectory of a typical rider. In this manner, although the rider may become weightless or airborne over the peak, the rider nevertheless remains within the sidewalls 44 of the chute and cannot achieve a substantial height above the bottom of the chute, which could result in an upset when the rider drops back into the bottom of the chute at some point along the further downhill section 42.

The relative velocity of riders and the resulting excitement and/or fear generated by the ride is subject to a degree of choice on the part of the operators of the amusement park and the customers they wish to attract. According to the preferred embodiment, the height of the parabolic arc at peak 40 is adjustable to allow for modifications in the event the ride is considered too exciting or not exciting enough. The legs 56 that support the radiating columns 48 at a common support are preferably arranged to telescope, being fixable in length at any of a plurality of predetermined heights. If it is desired to adjust the height of the peak 40 (a lower height providing a faster ride, and vice versa), transitional ones of the chute segments 28 at the cusps (e.g., segments disposed centrally along uphill section 36 and further downhill section 42) are removed. New transitional chute segments for the new length are installed and the telescoping legs 56 are fixed at the desired height.

The invention is operable in part because no pool of water can accumulate in the low area 62 at the junction between the downhill section 32 and the subsequent uphill section 36. Normally, in the configuration of a chute as shown, the low area 62 would fill with water up to the top of the sidewalls of the chute at the lowest point, where water would spill over. A rider dropping into the pool from section 32 would have a substantial downward momentum, being thereby forced downwardly into the pool. The rider's momentum would be substantially absorbed by the pool, leaving insufficient lateral momentum to progress over any substantial uphill section further along the course. According to the invention, however, the water tending to pool at the low area 62 is extracted by an elongated drain arranged and dimensioned to remove the water over an elongated section of the course, whereby sufficient water remains to reduce friction and provide a flow, but insufficient pooling occurs to retard the rider's progress. The elongated drain means for extraction of water is shown in FIGS. 1-4.

An elongated drain opening 60 is provided along the trough at said area 62 of relatively lower elevation. The elongated drain allows water to fall through the bottom of the chute preferably into an elongated receptacle conduit 66 disposed below the elongated drain opening for collecting water falling through the elongated opening. The collected water can be recycled by means of a pump 82 for moving the water to an area of higher elevation along the trough. In the embodiment shown, the water collected by conduit 66 at drain opening 60 is carried downwardly to splash down pool 38 by means of an appropriate conduit 68. The pump 82 raises the water from the splash down pool 38 to both the starting pool 22, where the water is injected via inlets 50, and to the water injection means 52 disposed on either side of the peak 40. Additional water injection devices such as geysers and misters can also be fed by water returned from the splash down pool, at any point where insufficient flow exists to keep the surface of the chute wet and slippery. These additional water injection devices have not been illustrated to avoid overburdening the drawing.

The elongated drain opening can be defined by an elongated slot along a low point in a cross-section of the trough at said area of relatively lower elevation. It is also possible to arrange a pattern of drain openings along the inner contour of the chute segments in this area. An elongated slot is preferred, however, as this enables the drain structure to be assembled conveniently to include a series of spacers separating longitudinal halves of the chute segments in the area of the drain. With reference to FIG. 3, two longitudinal halves 72 of a bifurcated segment of the chute are attached by means which space the two halves, the space allowing water to drop through into recovery conduit 66. The space an be maintained by washers or the like inserted between the facing surfaces of the two longitudinal sections 72, 72. Preferably, at least one elongated rail 76 is supported in the slot with an upper edge of the rail disposed flush with the surface of the trough. Spacing washers or the like are disposed on both sides of the rail 76, thereby providing a total drain opening made of a plurality of narrow slots. The riders are supported over the drain opening by the rail, and the slots are preferably too small for any portion of the rider's body or supporting mat to become caught, especially too small to catch the riders' toes. Moreover, the rail tends to guide the rider along the centerline of the chute.

The recovery chute 66 is supported in a U-shaped opening of a flange plate 64. As shown in FIG. 1, the flange plates 64 are provided between each connected pair of chute segments 28 in the low area 62. The chute segments are preferably attached along planes oriented perpendicular to the curve of the chute at each junction, at least some of the flange plates 64 being supported on columns 46. The flange plates can extend into the junction between the segments as shown in FIG. 3, where the flange plates are bolted, riveted or otherwise attached to the at least one of the segments 28 at each junction. A supplementary support bracket is preferably included to laterally and vertically support the segments relative to flange plate 64.

FIG. 4 illustrates a preferred arrangement for the elongated drain 60 and the rails disposed therein. For at least part of the length of the elongated drain, a plurality of rails 74, 76 are mounted in the drain opening defined between the facing surfaces o the segment halves 72 of the bifurcated chute in this area. Lateral rails 74 and central rail 76 are mounted via fasteners, namely bolts 78, and spacers 80, the bolts 78 attaching the segment halves 72 of the chute and also extending through the rails 74, 76. Inasmuch as at least the upper ones of the bolts 78 are relatively near the rider-supporting surface of the chute, these structures function in part as baffle means disposed in the elongated drain opening adjacent a surface of the trough. The water in the trough or chute flows substantially longitudinally, and in falling through the drain opening encounters these baffles. The baffles thus divert a portion of the water flowing in the trough across the drain upwardly to intersect the rider path, forming a form of geyser in the area of the drain opening.

Preferably, the waterslide is used together with a walkway 24 for riders to climb to the starting pool as shown in FIG. 1. A walkway allows potential riders to see the character of the ride before committing themselves to traversing the course. The walkway can be disposed alongside the waterslide as in FIG. 1, or preferably, arranged to cross over the waterslide, for example adjacent the area of the initial drop or near the peak 40 at which riders can become airborne. The overall apparatus is shown supported on columns. It will be appreciated that the waterslide and/or walkway can be supported directly by the ground if the topography of the site will allow.

The individual segments 28 of the chute are preferably molded reinforced fiberglass, which can be made appropriately smooth and formed to required shapes to define a continuously smooth trough or chute. The individual segments 28 can be attached together with interspersed seals to contain the water therein. The segments are preferably molded by laying out fiberglass on a cylindrical mold defining the inner contour of the chute, with flange edges and the like forming the body of the chute segments added thereto. The chute segments can be arranged integrally with high sidewalls 44, or as shown in FIG. 3, the sidewalls can be attached to a more standardized form of chute segment. Additional variations are also possible.

Figure 11:
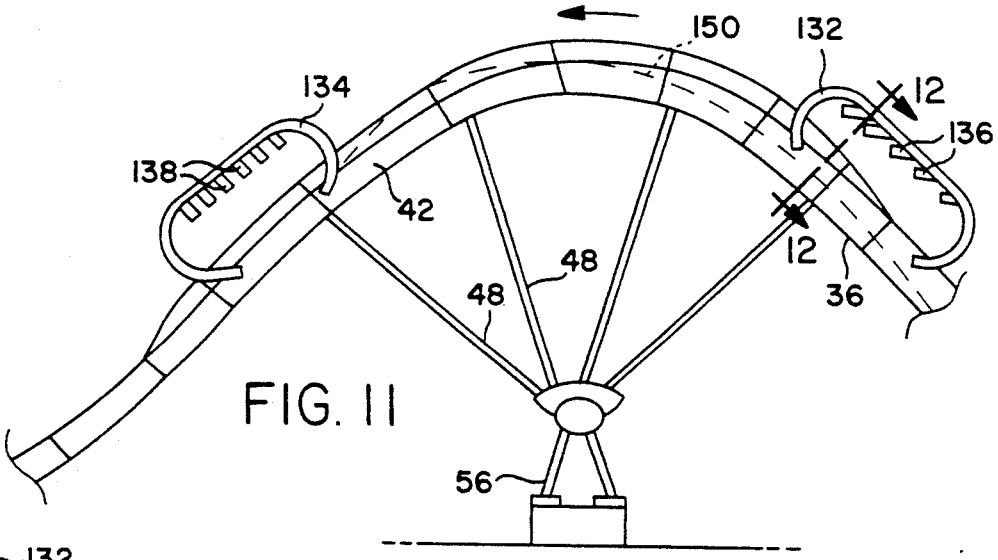
FIG. 11 is a partial elevation view of an alterative embodiment including velocity modifying jets; and, FIG. 12 is a partial section view taken along line 12—12 in FIG. 11.
Figure 12:
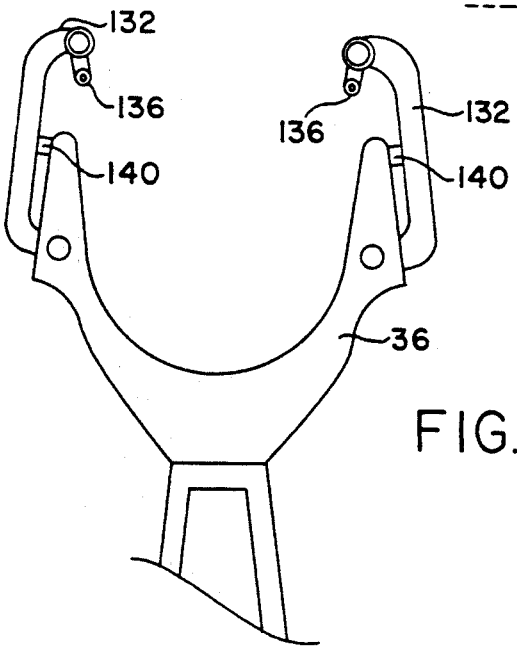

In the embodiment according to FIGS. 11 and 12, the water addition means along the uphill section 36 is arranged to at least partly assist riders over the crest of the hill. For this purpose, a water addition manifold 132 is provided and is coupled to a pump (not shown) via conduits in the sidewalls of the chutes, for directing a plurality of water jets into the path of the riders. The manifold 132 can be supported by its connections to the conduits, or additional supporting struts 140 can hold the manifold relative to the chute sections. Manifold 132 is coupled to water jet outlet ports 136 for a length of the uphill section 36, which ports direct a quantity of water over the crest of the hill. The ports 136 of manifold 132 can be directed such that a portion of the water runs backwards down the uphill section to reduce friction, as with water addition means 52 in FIG. 1. The outlet ports can be arranged parallel to one another and inclined forwardly along the sliding path, or as shown the outlet ports can be varied in angle such that the ports more remote from the crest are directed at a lower angle of incidence. The outlet ports can be, for example, five pairs of two inch diameter outlet pipes coupled to a pump providing a flow rate of water through the successive outlets of about 1,000 gallons per minute.

The inclined outlet nozzles assist the lighter and slower riders over the crest of the hill. A quantity of the water also passes over the crest and flows down the following section 42 to provide a low friction sliding surface there. Accordingly, the inclined outlets 136 of FIG. 11 effectively replace the water addition means 52 in FIG. 1, with the added benefit of assisting riders over the crest.

Inclined ports 136 are primarily helpful for the slower riders. By adding a sufficient quantity of water directed over the crest, however, for example on the order of 1,000 gallons per minute, the quantity of water flowing along the following section 42 becomes enough to have a braking effect on the faster riders as well. The braking is due to fluid dynamic friction and generation of a bow wave by a rider who is moving faster than the flowing water.

The trajectory of a rider moving faster than a speed corresponding to the parabolic arc over the crest is shown in FIG. 11 by dashed line 150. As the rider passes the crest of the hill the rider's velocity is such that the chute falls away beneath, and the rider falls back onto the chute along the downhill section 42. The sidewalls of the chute are high enough that the fastest rider cannot exceed the height of the chute walls. Nevertheless, the fast rider has excess velocity and assuming that downhill section 42 lead into a slash down pool the rider may skim over the surface of the pool for quite some distance. In order to allow a shorter splashdown pool and to minimize the possibility of damage from collisions, an additional braking water source can be provided to increase the depth of the water in the area where the fast rider returns to the chute. Manifold 134 is coupled to outlet ports 138 in this area, and is supplied by a pump in the same manner as the uphill manifold 132. The outlet ports 138 preferably are simply directed downwardly into the chute, and inasmuch as they primarily supply water rather than assist or retard the rider's passage due to the inertial effect of the water in the jets, a larger number of smaller ports are preferred. For example, twelve pairs of ¾" jets can be included to provide water at about 400 to 600 gallons per minute.

In order to safely traverse the waterslide without abrasion or the like, a particular form of rider support is preferred, as illustrated in FIGS. 6–10. The rider support has a front or bow which is turned upwardly over a bow support member 112 including handles to be grasped by the rider. The rider lies face down on the mat, looking forward over the bow of the rider support and is protected and contained by the bow structure. Two handles are preferred, whereby the rider can readily exert lateral and rotational force to orient the support and to remain in place on the support. A single handle is also possible. The handle bridge across a substantially U-shaped bow support web 116 disposed at a front of the support, the bow support web 116 having spaced legs oriented to extend rearwardly over and under one another, and a U-bow directed forwardly to form a blunt nose to the support. The handle 114 to be grasped by the rider has ends fixed respectively to the upper and lower spaced legs of the bow support web 116, the handle bridging across an opening defined by the legs of the bow support web. A flexible pad 110 is dimensioned to at least partly underlie the rider, the pad having a leading edge which is wrapped around the front of the bow support web 116 such that the pad is foremost. The pad is attached to at least one of the bow support web 116 and the handle 114, resulting in a protective front and a trailing supportive pad.

Preferably, each handle 114 is formed integrally with a section of bow support web 116, the rider support having two bow support elements of the type shown in FIG. 8, spaced laterally on the pad 110 as shown in FIG. 7. The pad can be attached to the bow forming elements 112 by means of fasteners passed through the pad and fixed in the bow forming element 112. FIG. 9 illustrates the pad 110 prior to attachment of the bow forming members 112. Holes 128, corresponding to the positions of holes 122 in the bow forming elements 112, are provided in the leading section of the pad 110 to be wrapped over elements 112. The pad as wrapped can be attached on the bow forming elements 112 by fasteners which each have an enlarged head to be disposed on an outer surface of the pad 110 and means engaging at least one of the bow support web and the handle. In the preferred embodiment shown, the fasteners are large push pins 124 with enlargements at the distal end of each pin, the push pins being forced through openings in the web 116 such that the enlargements expand on the inside surface of the web 116, locking the bow forming element 116 and the pad together. As shown cross-sectionally in FIG. 10, the pins 124 can be received in tubular projections of the bow support web 116. Alternatively and as shown in FIG. 8, the pins can be simply passed through a hole 122 in the web, resiliently compressing the mat 110 until the enlargements clear the holes 122 and fix together the mat 110 and bow forming element 112. The pins 124 are preferably removable so that the bow forming elements can be used on a new mat when a first mat becomes unduly worn.

The bow forming elements as well as the fasteners are preferably resilient plastic rather than wholly rigid material. At the rearmost, rider-facing edges of the web 116 of the bow forming elements 112, a rounded contour 118 prevents rider injury against the bow forming element 112 itself. In alternatives to the disclosed preferred embodiments, the fasteners can be of different structures, for example push-and-twist locked fasteners or threaded fasteners.

The mat 110 is preferably a buoyant plastic or rubber foam, preferably faced with textile material, for example a neoprene mat. The mat 110 is provided with two laterally-outwardly inclined portions 134, 132. The frontmost of these sections 134 provides an area against which the rider's elbows rest when using the apparatus. The rearmost of these sections provides an area on which the rider's body can remain on the mat even with some misorientation of the rider relative to the centerline of the mat 110. Furthermore, the laterally outwardly sloping edges of the sections 134, 132 provide a limited ability to steer the rider support apparatus as the rider tilts laterally to engage one or the other of the edges against the surface of the trough or chute.

The faster riders tend to use the handle means to keep the bow of the flotation apparatus lifted. This improves skimming over water surfaces, and reduces the generation of a bow wave.

The invention having been disclosed, a number of variations and alternatives will now become apparent to those skilled in the art. Reference should be made to the appended claims rather than the foregoing specification as defining the true scope of exclusive rights of the invention claimed.

I claim:

1. A waterslide, comprising:

an elongated trough defining a rider path proceeding generally from a higher elevation to a lower elevation, the trough having an uphill section followed by a downhill section at a crest, the uphill section following the downhill section along the rider path from the higher elevation to the lower elevation, such that the rider must traverse the crest in order to continue along the rider path;

means for injecting water into the trough along the uphill section approaching the crest, including means for directing a flow of water toward the crest, said flow of water intersecting the rider path and being arranged such that riders approaching the crest are assisted over the crest by said flow of water tending to push the riders over the crest from behind.

2. The waterslide according to claim 1, wherein the rider path defines an initial downhill section leading to the uphill section at a low point, and further comprising drain means operable to remove water from the trough at the low point.

3. The waterslide according to claim 1, wherein the rider path defines an initial downhill section leading to the uphill section, and wherein the initial downhill section and the uphill section along the are dimensioned such that kinetic energy accumulated by the rider between a start of the waterslide and an end of the uphill section is sufficient to carry faster riders over the crest, and wherein the waterslide includes means for adding a quantity of water along the downhill section in sufficient depth to brake the faster riders by generation of a bow wave.

4. The waterslide according to claim 1, wherein the means for injecting water into the trough includes a plurality of outlet ports arranged such that a portion of water injected by the outlet ports establishes a flow of water in a backward direction relative to the rider path along said uphill section of the trough, said flow of water in the backward direction being sufficient to reduce surface friction along the uphill section.

5. The waterslide according to claim 4, wherein the means for injecting water into the trough, establishes a flow of water in a forward direction along the rider path at the downhill section.

6. The waterslide according to claim 4, wherein the kinetic energy accumulated by the faster riders approaching the crest is more than sufficient to carry the faster riders over the crest, whereby the rider free falls over at least a part of the downhill section, and wherein the waterslide includes means for injecting sufficient water along the downhill section for braking the faster riders by generation of a bow wave in the downhill section.

7. The waterslide according to claim 1, wherein the water extraction means includes an elongated drain opening along the trough at said area of relatively lower elevation.

8. The waterslide according to claim 7, further comprising baffle means disposed in the elongated drain opening adjacent a surface of the trough, thereby diverting a portion of the water flowing in the trough across the drain upwardly to intersect the rider path.

9. A waterslide, comprising:

an elongated trough defining a rider path proceeding generally from a higher elevation to a lower elevation, the trough having an uphill section followed by a downhill section at a crest and being arranged such that faster riders can become airborne over the crest;

means for injecting water into the trough along the downhill section following the crest, the water flowing in the downhill section at a slower velocity than the faster riders, and tending to brake said faster riders.

10. The waterslide according to claim g, wherein the means for injecting water includes a plurality of outlet ports disposed along the uphill section approaching the crest, the outlet ports being arranged to direct at least a portion of water emitted by the outlet ports over the crest, whereby slower riders are assisted over the crest and the faster riders are braked by the water along the downhill section.

11. The waterslide according to claim 10, wherein the outlet ports direct water into the uphill section at a rate of about 1,000 gallons per minute.

12. The waterslide according to claim 10, wherein the outlet ports are arranged at progressively lower angles of incidence relative to the uphill section proceeding in a direction away from the crest.

13. A rider supporting apparatus for a waterslide, comprising:

at least one substantially U-shaped bow support web disposed at a front of the apparatus, the bow support web having spaced legs oriented to extend rearwardly of the apparatus and a U-bow directed forwardly;

a handle graspable by the rider and having ends fixed to the spaced legs of the bow support web, the handle bridging across an opening defined by the legs of the bow support web;

a flexible pad dimensioned to at least partly underlie the rider, the pad having a leading edge wrapped over the bow support web such that the bow support is disposed behind the pad; and, means attaching the pad to at least one of the bow support web and the handle.

14. The rider supporting apparatus according to claim 13, wherein the legs of the bow support web are disposed over and under one another, the pad being wrapped around the bow support web on an arc having a horizontal axis, and the handle extending vertically between the legs.

15. The rider supporting apparatus according to claim 14, comprising two handles spaced laterally along the leading edge of the pad.

16. The rider supporting apparatus according to claim 14, wherein each of the two handles is attached to a separate said bow support web, the bow support webs being spaced laterally adjacent the leading edge.

17. The rider supporting apparatus according to claim 13, wherein the handle and the bow support web are integrally molded.

18. The rider supporting apparatus according to claim 13, wherein the U-shaped bow support web bulges upwardly at the U-bow such that a lower portion of the U-bow forms a smoothly rounded underside on the pad and a blunt nose.

19. The rider supporting apparatus according to claim 13, wherein the pad has laterally outwardly inclined edges proceeding rearwardly from the bow support web.

20. The rider supporting apparatus according to claim 13, wherein the handle and the bow support web form an integral body, and wherein the integral body is attached to the pad via fasteners extending through the pad into the integral body.

* * * * *